US010883163B2

(12) United States Patent
Kasai et al.

(10) Patent No.: US 10,883,163 B2
(45) Date of Patent: Jan. 5, 2021

(54) METHOD FOR MANUFACTURING HIGH-SILICON STEEL STRIP BY CONTINUOUS SILICONIZING

(71) Applicant: JFE STEEL CORPORATION, Tokyo (JP)

(72) Inventors: Shoji Kasai, Tokyo (JP); Takashi Doi, Tokyo (JP); Masatoshi Nishide, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 485 days.

(21) Appl. No.: 15/757,807

(22) PCT Filed: Sep. 1, 2016

(86) PCT No.: PCT/JP2016/003987
§ 371 (c)(1),
(2) Date: Mar. 6, 2018

(87) PCT Pub. No.: WO2017/043052
PCT Pub. Date: Mar. 16, 2017

(65) Prior Publication Data

US 2018/0245196 A1 Aug. 30, 2018

(30) Foreign Application Priority Data

Sep. 8, 2015 (JP) ..... 2015-176485

(51) Int. Cl.
*C23C 10/08* (2006.01)
*C21D 9/46* (2006.01)
(Continued)

(52) U.S. Cl.
CPC ..... *C23C 10/08* (2013.01); *C21D 9/46* (2013.01); *C21D 9/56* (2013.01); *C23C 10/02* (2013.01)

(58) Field of Classification Search
CPC .. C21D 9/46; C21D 9/56; C23C 10/02; C23C 10/08
See application file for complete search history.

(56) References Cited

FOREIGN PATENT DOCUMENTS

JP 07310165 A 11/1995
JP 10212566 A 8/1998
(Continued)

OTHER PUBLICATIONS

International Search Report and Written Opinion for International Application No. PCT/JP2016/003987, dated Oct. 4, 2016, 5 pages.
(Continued)

*Primary Examiner* — Lois L Zheng
(74) *Attorney, Agent, or Firm* — Ratnerprestia

(57) ABSTRACT

A high-silicon steel strip is manufactured. A basic configuration includes partition plates arranged in the longitudinal direction of a furnace to extend from a position in the vicinity of respective gas nozzles to be in parallel to the pass line of the steel strip, and obstacles arranged to face partition-plate rear edges in the longitudinal direction of the furnace to obstruct the flow of the gas along the steel strip so that siliconizing spaces surrounded by the steel strip, the partition plates, and the obstacles are formed; and gaps between the partition-plate rear edges and the obstacles and so forth which form exhaust passages through which gas is discharged from the siliconizing spaces to other spaces inside the furnace so that treatment gas which has been sprayed from the gas nozzles onto a surface of the steel strip to flow through the siliconizing spaces is discharged through the exhaust passages.

4 Claims, 2 Drawing Sheets

(51) Int. Cl.

| | |
|---|---|
| ***C21D 9/56*** | (2006.01) |
| ***C23C 10/02*** | (2006.01) |
| *C23C 10/06* | (2006.01) |
| *C21D 9/48* | (2006.01) |

(56) References Cited

FOREIGN PATENT DOCUMENTS

| | | | |
|---|---|---|---|
| JP | 10237621 | A | 9/1998 |
| JP | 10330908 | A | 12/1998 |
| JP | 11131149 | A | 5/1999 |
| JP | 2947067 | B2 | 9/1999 |
| JP | 3257435 | B2 | 2/2002 |
| JP | 5664286 | B2 | 2/2015 |

OTHER PUBLICATIONS

Taiwan Office Action for Taiwan Application No. 105128788, dated May 8, 2017, including Concise Statement Search Report, 4 pages.
Chinese Office Action for Chinese Application No. 201680051507.2, dated Apr. 1, 2019 with Concise Statement of Relevance of Office Action, 8 pages.
Extended European Search Report for European Application No. 16843920.6, dated Jun. 26, 2018, 8 pages.
European Communication pursuant to Article 94(3) for European Application No. 15 843 920.6, dated Jun. 4, 2019, 3 pages.

METHOD FOR MANUFACTURING HIGH-SILICON STEEL STRIP BY CONTINUOUS SILICONIZING

CROSS REFERENCE TO RELATED APPLICATIONS

This is the U.S. National Phase application of PCT/JP2016/003987, filed Sep. 1, 2016, which claims priority to Japanese Patent Application No. 2015-176485, filed Sep. 8, 2015, the disclosures of these applications being incorporated herein by reference in their entireties for all purposes.

TECHNICAL FIELD OF THE INVENTION

The present invention relates to a method for manufacturing a high-silicon steel strip by performing a siliconizing treatment on a steel strip in a continuous siliconizing furnace.

BACKGROUND OF THE INVENTION

A high-silicon steel sheet is often used for iron cores of transformers and motors because such a steel sheet has an excellent high-frequency magnetic property represented by, for example, low iron loss and high magnetic permeability. In particular, it is known that a high-silicon steel sheet exhibits an excellent high-frequency magnetic property such as a magnetostriction quantity of 0 and the peak value of maximum magnetic permeability at a Si concentration of 6.5 mass %. Conventionally, known examples of a method for manufacturing such a high-silicon steel sheet include continuous siliconizing in which a low-silicon steel strip, which is obtained by performing rolling, is subjected to a siliconizing treatment in order to allow Si to penetrate and diffuse through the surface of the steel strip.

Generally, in continuous siliconizing, a siliconizing treatment is performed on a steel strip by spraying treatment gas containing Si compounds onto the steel strip which travels through a horizontal-type continuous siliconizing furnace. In the continuous siliconizing furnace, plural hearth rolls for horizontally transporting a steel strip are arranged, plural pairs of gas nozzles, each pair including gas nozzles above and below the pass line of the steel strip, are arranged at intervals in the longitudinal direction of the furnace, and treatment gas is sprayed through the respective gas nozzles onto both surfaces of the steel strip, which is transported by the hearth rolls, in order to continuously add Si to the steel strip through the reaction between the treatment gas and the steel strip.

In the case of such a method for manufacturing a high-silicon steel strip which utilizes continuous siliconizing, efficiently performing a siliconizing treatment is an important issue to be addressed. In particular, a decrease in the reaction efficiency of supplied treatment gas (gas containing Si compounds) causes an increase in the size of a continuous siliconizing furnace and a decrease in treatment speed, which makes it difficult to manufacture a high-silicon steel strip at low cost.

In order to increase the reaction efficiency of a treatment gas, the treatment gas needs to be efficiently in contact with a steel strip so that a siliconizing reaction effectively occurs. In order to allow a siliconizing reaction to effectively occur, it is necessary to prepare a space (siliconizing space), in which the reaction between the steel strip and the treatment gas occurs, so that the treatment gas (unreacted gas) which is not yet reacted with the steel strip only by having been sprayed onto the steel strip may stay around the steel strip and effectively react with the steel strip, that is, it is necessary to promote a reaction through an atmosphere siliconizing treatment, and at the same time, it is necessary to prevent atmosphere gas in the furnace from entering the space.

In the case of the method for manufacturing a high-silicon steel strip according to Patent Literature 1, in order to generate a homogeneous siliconizing reaction on the surface of a steel strip, a partition plate is arranged between the respective gas nozzles in the longitudinal direction of the furnace to be substantially in parallel to the pass line of a steel strip so that a treatment gas, which is sprayed from the gas nozzles onto the surface of the steel strip, is guided to the space between the partition plate and the steel strip to flow along the steel strip. According to this manufacturing method, since a siliconizing space is formed by the partition plate, the treatment gas, which is sprayed onto the steel strip, is prevented from flowing away from the steel strip, that is, allowed to stay around the steel strip, and atmosphere gas in the furnace is prevented from entering the siliconizing space, in which the reaction between the steel strip and the treatment gas occurs, resulting in a certain level of effect being realized.

CITATION LIST

Patent Literature

PTL 1: Japanese Unexamined Patent Application Publication No. 7-310165

SUMMARY OF THE INVENTION

However, in the case where a siliconizing space is formed by partition plates in a furnace, if it is not possible to appropriately discharge by-products generated by a siliconizing reaction from the siliconizing space, iron in the treatment gas which have been replaced with silicon adhere again to the surface of the steel strip, causing a problem of a deterioration in the surface quality of the steel strip. Therefore, in the case where a partition plate is simply placed as in the case of Patent Literature 1, it is not possible to efficiently manufacture a high-silicon steel strip having good surface quality, because it is not possible to satisfy the following requirements at the same time, that is, requirement (i) that the reaction efficiency of treatment gas be increased and requirement (ii) that good surface quality of a steel strip be achieved.

Therefore, an object of aspects of the present invention is, by solving the problems of the conventional techniques described above, to provide a method for efficiently manufacturing a high-silicon steel strip having an excellent surface quality by increasing the reaction efficiency of treatment gas and by appropriately discharging by-products generated by a siliconizing reaction from the siliconizing space in order to prevent a deterioration in the surface quality of the steel strip.

The present inventors diligently conducted investigations in order to solve the problems described above and, as a result, found that, in a method in which treatment gas is sprayed onto a steel strip from plural gas nozzles 1 which are arranged at intervals in the longitudinal direction of a furnace, when a basic configuration includes (i) partition plates 2 arranged in the longitudinal direction of the furnace to extend from a position in the vicinity of the respective gas nozzles 1 to be in parallel to the pass line of the steel strip, and obstacles 3 arranged so as to face partition-plate rear edges 20 in the longitudinal direction of the furnace to obstruct the flow of the gas along the steel strip so that siliconizing spaces s surrounded by the steel strip, the partition plates 2, and the obstacles 3 are formed, and (ii) gaps $e_a$ between the partition-plate rear edges 20 and the obstacles 3 and so forth which form exhaust passages e through which gas is discharged from the siliconizing spaces s to other spaces inside the furnace so that the treatment gas which has been sprayed from the gas nozzles 1 onto the surface of the steel strip to flow through the siliconizing spaces s is discharged through the exhaust passages e, and the relationship between the volume of the siliconizing spaces s and the area of the exhaust passages e is optimized under a certain condition in accordance with the amount of the steel strip in the siliconizing spaces s, it is possible to achieve a high reaction efficiency and to prevent a deterioration in the surface quality of the steel strip with appropriately discharging by-products generated by a siliconizing reaction from the siliconizing spaces s.

The present invention has been completed on the basis of the findings described above, and the subject matter of aspects of the present invention is as follows.

[1] A method for manufacturing a high-silicon steel strip in which treatment gas containing Si compounds is sprayed onto a steel strip traveling through a horizontal-type continuous siliconizing furnace to perform a siliconizing treatment on the steel strip, the method including using a continuous siliconizing furnace including gas nozzles (1) arranged above and below a pass line of the steel strip at intervals in a longitudinal direction of the furnace to spray treatment gas onto the steel strip traveling through the furnace, partition plates (2) arranged above and below the pass line of the steel strip in the longitudinal direction of the furnace to extend from a position in the vicinity of the respective gas nozzles (1) so as to be substantially in parallel to the pass line of the steel strip, and obstacles (3) arranged to face partition-plate rear edges (20) in the longitudinal direction of the furnace to obstruct a flow of the gas along the steel strip, in which spaces surrounded by the traveling steel strip, the partition plates (2), and the obstacles (3) (the spaces excluding a portion in the longitudinal direction where the steel strip is not substantially siliconized) form siliconizing spaces (s) where the steel strip is siliconized by the treatment gas, gaps ($e_a$) between the partition-plate rear edges (20) and the obstacles (3), and gaps ($e_b$) between partition-plate side edges (21) and an inner wall of the furnace (the gaps excluding a portion of gaps through which the treatment gas flowing through the siliconizing spaces (s) is not substantially discharged), form exhaust passages (e) through which gas is discharged from the siliconizing spaces (s) to other spaces inside the furnace, and the treatment gas which has been sprayed from the gas nozzles (1) onto a surface of the steel strip to flow through the siliconizing spaces (s) (the treatment gas containing by-products generated by a reaction with the steel strip) is discharged through the exhaust passages (e); and performing the siliconizing treatment under a condition that satisfies relational expressions below.

$$A=T\times W\times L_S\times 10^3/([V_S]^{1/2}\times S_o),\ 0.005<A<0.750,$$

where, $S_o$: total area ($mm^2$) of the exhaust passages (e) formed above and below the pass line of the steel strip, $V_S$: total volume ($mm^3$) of the siliconizing spaces (s) formed above and below the pass line of the steel strip, $L_S$: length (mm) of the steel strip in the siliconizing spaces (s), W: width (mm) of the steel strip, and T: thickness (mm) of the steel strip.

[2] The method for manufacturing a high-silicon steel strip by continuous siliconizing according to item [1] above, in which the siliconizing treatment is performed under a condition that satisfies a relationship of $$0.040\leq A\leq 0.700.$$

[3] The method for manufacturing a high-silicon steel strip by continuous siliconizing according to item [1] or [2] above, in which the obstacles (3) below the pass line of the steel strip are hearth rolls for transporting the steel strip.

According to aspects of the present invention, it is possible to increase the reaction efficiency of treatment gas and to prevent a deterioration in the surface quality of a steel strip by appropriately discharging by-products generated by a siliconizing reaction from siliconizing spaces, and therefore it is possible to efficiently manufacture a high-silicon steel strip having an excellent surface quality.

DETAILED DESCRIPTION OF EMBODIMENTS OF THE INVENTION

One aspect of the present invention is a method for manufacturing a high-silicon steel strip, the method including performing a siliconizing treatment on a steel strip by spraying treatment gas containing Si compounds onto the steel strip traveling through a horizontal-type continuous siliconizing furnace. Here, the term "high-silicon steel strip" generally denotes a steel strip having a Si content (average concentration) of 3.0 mass % or more.

Figure 1:
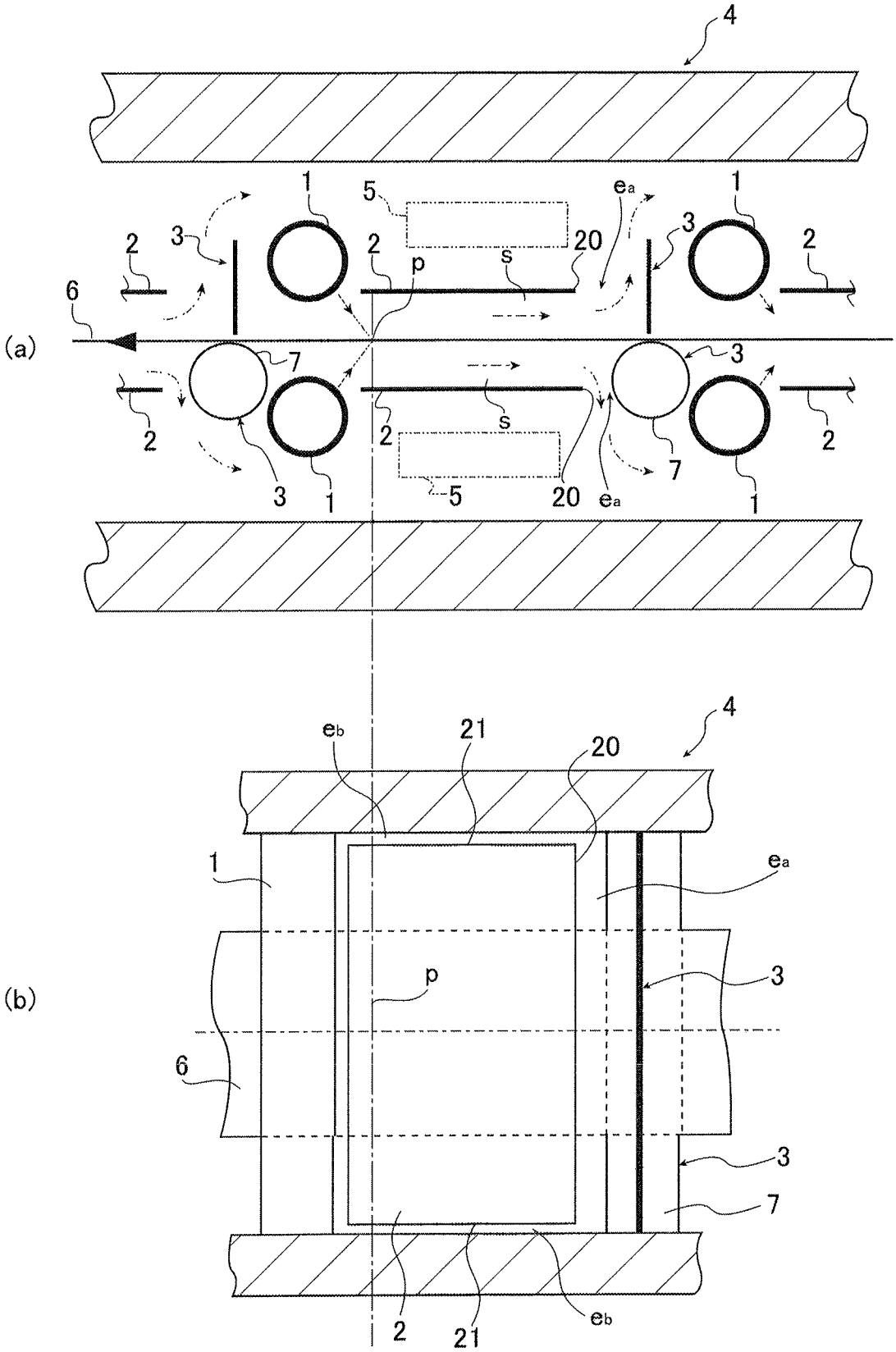
FIG. 1 illustrates an embodiment of a method according to aspects of the present invention, where FIG. 1(*a*) is a diagram illustrating a vertical sectional view of a continuous siliconizing furnace and FIG. 1(*b*) is a diagram illustrating a horizontal sectional view of the continuous siliconizing furnace.

FIG. 1 illustrates an embodiment of a method according to aspects of the present invention, where FIG. 1(*a*) is a diagram illustrating a vertical sectional view of a continuous siliconizing furnace and FIG. 1(*b*) is a diagram illustrating a horizontal sectional view of the continuous siliconizing furnace. In FIG. 1, reference sign 4 indicates a furnace body (furnace wall), reference sign 5 indicates a heating device, reference sign 6 indicates a steel strip horizontally traveling through the furnace, and reference sign 7 denotes a hearth roll for transporting a steel strip.

Here, although the direction of gas flow is opposite to the transport direction of the steel strip 6 in the longitudinal direction of the furnace in the present embodiment, the direction of gas flow and the moving direction of the steel strip 6 may be the same.

This continuous siliconizing furnace has plural gas nozzles 1, and partition plates 2 and obstacles 3 for forming siliconizing spaces s corresponding to the respective gas nozzles 1.

The gas nozzle 1 described above is used for spraying treatment gas onto a traveling steel strip 6 from above or below the traveling steel strip 6, and plural nozzles (plural pairs, where one pair consists of an upper gas nozzle and a lower gas nozzle) are arranged above and below the pass line of the steel strip at intervals in the longitudinal direction of the furnace.

In accordance with aspects of the present invention, treatment gas is supplied to a steel strip to be subjected to a siliconizing treatment by using a method in which the treatment gas is sprayed onto both surfaces of the steel strip from the gas nozzles 1 in order to increase the reaction efficiency of the treatment gas. By spraying the treatment gas onto the steel strip from the plural gas nozzles 1 arranged at intervals in the longitudinal direction of the furnace, a continuous siliconizing treatment is realized.

The partition plates 2 are arranged above and below the pass line of the steel strip in the longitudinal direction of the furnace to extend from a position in the vicinity of the respective gas nozzles 1 to be substantially in parallel to the pass line of the steel strip. As described below, such partition plates 2 form siliconizing spaces s along with the steel strip 6 and the obstacles 3 so that the treatment gas which is sprayed onto the steel strip 6 is prevented from flowing away from the steel strip 6 (allowed to stay around the steel strip). In addition, the partition plates 2, which are members for preventing atmosphere gas in the furnace from entering the siliconizing spaces s, are arranged at a certain distance from the pass line of the steel strip so that the treatment gas which is sprayed onto the steel strip from the gas nozzles 1 is allowed to directly enter the siliconizing spaces s.

The obstacles 3 described above are arranged to face the partition-plate rear edges 20 in the longitudinal direction of the furnace (the partition-plate edges on the side opposite to the gas nozzles 1 in the longitudinal direction of the partition plates) in order to obstruct the gas flow along the steel strip. Any configuration may be used for the obstacles 3 as long as it is possible to functionally obstruct the gas flow. In the present embodiment, each of the obstacles 3 above the pass line of the steel strip is composed of a plate-like member which is vertically arranged, and each of the obstacles 3 below the pass line of the steel strip is composed of a hearth roll 7 for transporting the steel strip. The plate-like member, of which the upper obstacle 3 is composed, is arranged so that the upper edge of the member is positioned higher than the upper surface of the partition plate 2 and so that the lower edge of the member is close to the pass line of the steel strip and directly above the hearth roll 7 (obstacle 3 below the pass line).

Here, each of the obstacles 3 below the pass line of the steel strip may also be composed of, for example, a plate-like member as in the case of the upper obstacles 3. In this case, the plate-like member, of which the lower obstacle 3 is composed, is arranged so that the lower edge of the member is lower than the lower surface of the partition plate 2 and so that the upper edge of the member is close to the pass line of the steel strip.

Spaces which are surrounded by the traveling steel strip 6, the partition plates 2, and the obstacles 3 form siliconizing spaces s in which the steel strip is siliconized by the treatment gas. Here, such siliconizing spaces s are limited to spaces in which the siliconizing reaction of the steel strip 6 substantially occurs. Therefore, as illustrated in FIG. 1, in the case where the point p at which the treatment gas sprayed from the gas nozzle 1 is brought into contact with the surface of the steel strip is located within the space formed by the partition plates 2 and the steel strip 6, since a siliconizing reaction does not substantially occur in the portion of the space on the side of the gas nozzles from the point p, such a portion of the space is excluded from the siliconizing space s.

In addition, gaps $e_a$ between the partition-plate rear edges 20 and the obstacles 3 and gaps $e_b$ between the partition-plate side edges 21 (both side edges) and the inner wall of the furnace form exhaust passages e through which gas is discharged from the siliconizing spaces s to other spaces inside the furnace. Here, such gaps $e_b$ are limited to the portion through which the treatment gas flowing in the siliconizing spaces s is substantially discharged. Therefore, as illustrated in FIG. 1, in the case where the point p at which the treatment gas sprayed from the gas nozzle 1 is brought into contact with the surface of the steel strip is located within the space formed by the partition plates 2 and the steel strip 6, since the treatment gas is not substantially discharged through the portion of the gaps on the side of the gas nozzles from the point p, such a portion of the gaps is excluded from the gaps $e_b$.

Figure 2:
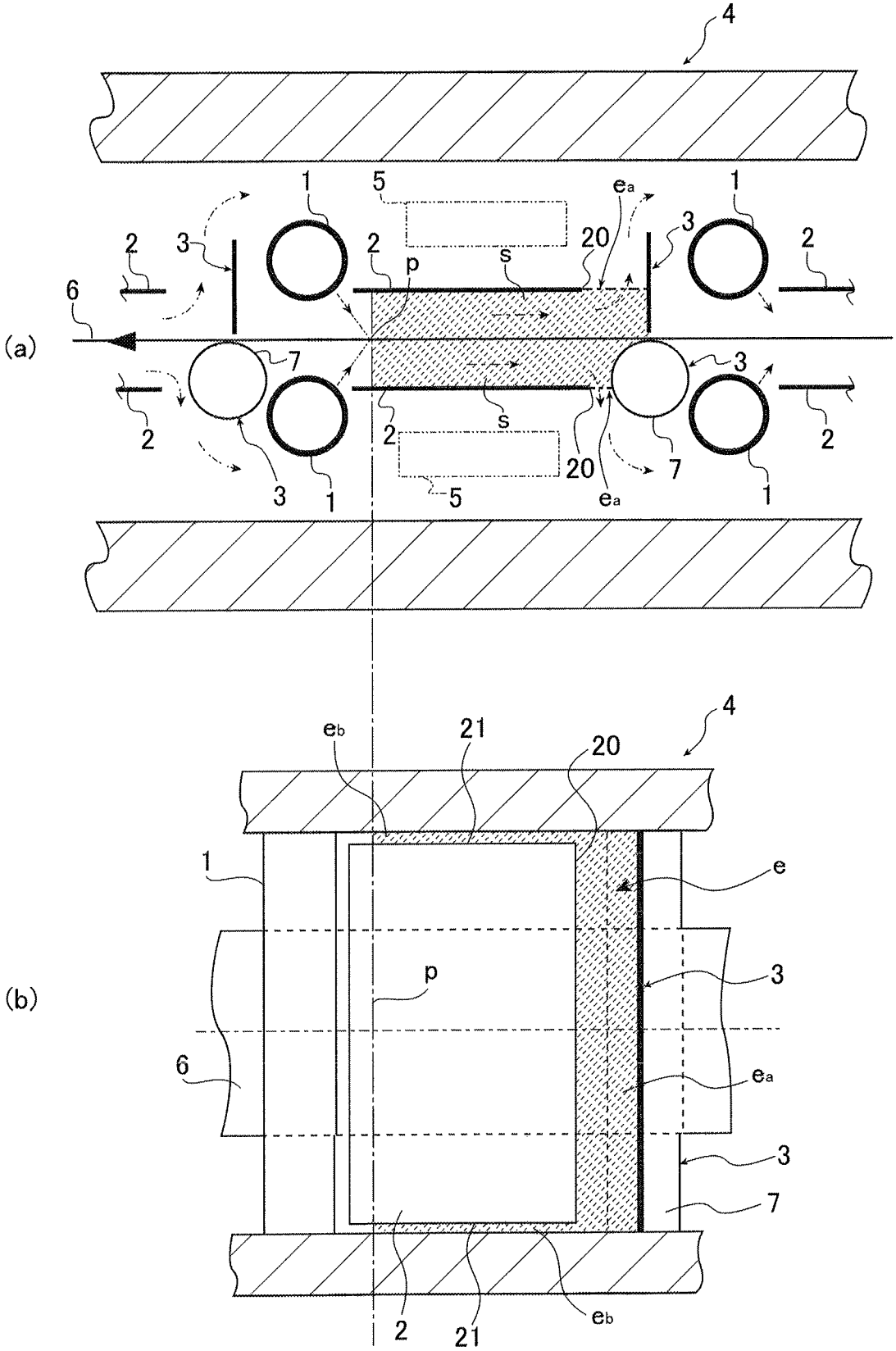
FIGS. 2(*a*) and 2(*b*) are diagrams illustrating regions of siliconizing spaces s and exhaust passages e of FIGS. 1(*a*) and 2(*b*) respectively.

In FIG. 2, respective regions of the siliconizing spaces s and exhaust passages e (gaps $e_a$+gaps $e_b$) are illustrated by a hatched pattern with dashed lines.

The siliconizing spaces s and the exhaust passages e formed by the partition plates 2 and the obstacles 3 as described above are provided for the respective gas nozzles 1.

Here, in the case where a steel strip is subjected to a siliconizing treatment in a continuous siliconizing furnace, it may be taken into a consideration that the whole space in the furnace is used as a siliconizing space without forming siliconizing spaces s separated by partition plates 2 as in the case of aspects of the present invention. However, since it is necessary to place at least heating devices 5, hearth rolls 7 for transporting a steel strip, and gas nozzles 1 in a furnace in order to industrially manufacture a high-silicon steel strip by continuously performing a siliconizing treatment on a steel strip at a high temperature, a large space is necessary in the furnace. Since treatment gas which is sprayed onto the surface of a steel strip from gas nozzles 1 flows away from the steel strip 6 and diffuses in such a large space in the furnace, it is not possible to achieve sufficient reaction efficiency. Therefore, it is necessary to promote a reaction through atmosphere siliconizing by forming siliconizing spaces s through the use of partition plates 2 in order to allow treatment gas to stay around a steel strip.

In addition, in the case where the edges of a steel strip 6 traveling through a furnace are close to the inner wall surface of the furnace, gas does not move smoothly between the siliconizing spaces s above and below the pass line of the steel strip. Therefore, it is necessary to form an exhaust passage e for each of the siliconizing spaces s above and below the pass line of the steel strip.

From the gas nozzles 1, treatment gas is sprayed onto the surface of a steel strip at the entrance of the siliconizing spaces s. In FIG. 1 and FIG. 2, dashed arrows indicate the flow of the gas.

Part of the treatment gas which is sprayed onto the surface of the steel strip from the gas nozzles 1 reacts with the steel strip 6 so that siliconizing occurs. In addition, since the unreacted treatment gas flows in the siliconizing spaces s and stays around the steel strip so that the gas reacts with the steel strip 6, further siliconizing occurs. Finally, the treatment gas containing by-products which has been generated by the reaction with the steel strip 6 is discharged through the exhaust passages e.

As described above, in the case where siliconizing spaces s are formed by partition plates 2, if it is not possible to appropriately discharge by-products generated by a siliconizing reaction from the siliconizing spaces s, iron (iron chloride in the case where the treatment gas contains $SiCl_4$) in the treatment gas which has been replaced with silicon adheres again to the surface of the steel strip, causing a problem of a deterioration in the surface quality of the steel strip. Therefore, it is not possible to satisfy the following requirements at the same time, that is, requirement (i) that the reaction efficiency of treatment gas be increased, and requirement (ii) that good surface quality of a steel strip be achieved.

Therefore, in accordance with aspects of the present invention, in the continuous siliconizing furnace having the basic configuration described above, the relationship between the volume of the siliconizing spaces s and the area of the exhaust passages e is optimized in accordance with the amount of the steel strip in the siliconizing spaces s, and a siliconizing treatment is performed under the condition that satisfies the relational expressions below.

$$A=T\times W\times L_S\times 10^3/([V_S]^{1/2}\times S_o),\ 0.005<A<0.750,$$

where, $S_o$: total area ($mm^2$) of the exhaust passages (e) arranged above and below the pass line of the steel strip, $V_S$: total volume ($mm^3$) of the siliconizing spaces (s) arranged above and below the pass line of the steel strip, $L_S$: length (mm) of the steel strip in the siliconizing spaces (s), W: width (mm) of the steel strip, and T: thickness (mm) of the steel strip.

In the case of such a siliconizing treatment, since treatment gas sprayed onto the steel strip 6 stays around the steel strip as a result of its flowing in the siliconizing spaces s, the reaction between the gas and the steel strip is promoted. In addition, atmosphere gas in the furnace does not enter the siliconizing spaces. Therefore, it is possible to achieve high reaction efficiency of the treatment gas. On the other hand, since it is possible to appropriately discharge by-products generated by a siliconizing reaction from the siliconizing spaces s, it is possible to prevent a deterioration in the surface quality of a steel strip due to iron in the treatment gas which has been replaced with silicon again adhering to the surface of the steel strip. Therefore, it is possible to manufacture a high-silicon steel strip having good surface quality with a high reaction efficiency.

In addition, in order to further increase the effects described above, it is preferable to perform a siliconizing treatment under the condition that satisfies the relational expression below, which imposes a severer limitation.

$$0.040\leq A\leq 0.700$$

It is preferable that A be 0.040 or more, or more preferably 0.070 or more, because this results in a higher reaction efficiency.

EXAMPLES

By performing a siliconizing treatment on steel strips (3.0-mass %-Si containing materials) having a thickness of 0.1 mm by treatment gas containing $SiCl_4$ in a continuous siliconizing furnace having the equipment configuration illustrated in FIG. 1, high-silicon steel strips (6.5-mass %-Si materials) were manufactured. At that time, the total volume $V_S$ of siliconizing spaces s and the total area $S_o$ of exhaust passages e were changed, and the reaction efficiency of the treatment gas and the surface quality of the high-silicon steel strip manufactured were investigated. The results are given in Table 1.

Here, it is particularly desirable that the reaction efficiency be 0.2 or more. On the other hand, in the case where the reaction efficiency is less than 0.1, there is a significant decrease in efficiency and an increase in cost from the viewpoint of industrial production. Therefore, a case of a reaction efficiency of 0.20 or more was judged as "Excellent", a case of a reaction efficiency of 0.15 or more and less than 0.20 was judged as "Good", a case of a reaction efficiency of 0.10 or more and less than 0.15 was judged as "Fair", and a case of a reaction efficiency of less than 0.10 was judged as "Poor". Then, the cases of "Excellent", "Good", and "Fair" were judged as satisfactory.

As Table 1 indicates, it was not possible to achieve sufficient reaction efficiency in the case where the value of A was less than the range according to aspects of the present invention. On the other hand, in the case where the value of A was more than the range according to aspects of the present invention, since the amount of gas discharged from the siliconizing spaces s was insufficient due to the area of the exhaust passages e being insufficient, there was a deterioration in the surface quality due to iron powder adhering to the surface of the steel strip.

In addition, among the examples of the present invention, in the case where the value of A was 0.040 to 0.700, it was possible to achieve particularly high reaction efficiency and an excellent surface quality.

TABLE 1

| | Steel Strip Size (mm) | | | Total | Total | | Evaluation Result | | | |
|---|---|---|---|---|---|---|---|---|---|---|
| No. | Thickness T | Width W | Length $L_s$ of Steel Strip in Siliconizing Spaces s | Volume $V_s$ of Siliconizing Spaces s ($mm^3$) | Area $S_o$ of Exhaust Passages e ($mm^2$) | Value of A | Surface Quality of Steel Strip | | Reaction Efficiency *1 | Class |
| 1 | 0.1 | 600 | 1000 | 121,500,000 | 53,000 | 0.103 | Good | 0.25 | Excellent | Example |
| 2 | 0.1 | 600 | 1000 | 121,500,000 | 7,800 | 0.698 | Good | 0.31 | Excellent | Example |
| 3 | 0.1 | 600 | 1000 | 121,500,000 | 7,250 | 0.751 | Poor (Iron Powder Adhesion) | 0.32 | Excellent | Comparative Example |
| 4 | 0.1 | 450 | 1000 | 121,500,000 | 53,000 | 0.077 | Good | 0.26 | Excellent | Example |
| 5 | 0.1 | 450 | 1000 | 121,500,000 | 100,000 | 0.041 | Good | 0.18 | Good | Example |

TABLE 1-continued

| No. | Steel Strip Size (mm) Thickness T | Width W | Length $L_s$ of Steel Strip in Siliconizing Spaces s | Total Volume $V_s$ of Siliconizing Spaces s ($mm^3$) | Total Area $S_o$ of Exhaust Passages e ($mm^2$) | Value of A | Evaluation Result Surface Quality of Steel Strip | Reaction Efficiency *1 | | Class |
|---|---|---|---|---|---|---|---|---|---|---|
| 6 | 0.1 | 450 | 1000 | 720,000,000 | 240,000 | 0.007 | Good | 0.12 | Fair | Example |
| 7 | 0.1 | 410 | 1000 | 45,000,000 | 1,260,000 | 0.005 | Good | 0.05 | Poor | Comparative Example |

*1 reaction efficiency = (the amount of $SiCl_4$ used for reaction)/(the amount of $SiCl_4$ supplied to the furnace)

REFERENCE SIGNS LIST

1 gas nozzle
2 partition plate
3 obstacle
4 furnace body
5 heating device
6 steel strip
7 hearth roll
20 partition-plate rear edge
21 partition-plate side edge
s siliconizing space
$e_a$, $e_b$ gap
e exhaust passage

The invention claimed is:

1. A method for manufacturing a high-silicon steel strip in which treatment gas containing Si compounds is sprayed onto a steel strip traveling through a horizontal-type continuous siliconizing furnace to perform a siliconizing treatment on the steel strip, the method comprising:

using a continuous siliconizing furnace including gas nozzles (1) arranged above and below a pass line of the steel strip at intervals in a longitudinal direction of the furnace to spray treatment gas onto the steel strip traveling through the furnace, partition plates (2) arranged above and below the pass line of the steel strip in the longitudinal direction of the furnace to extend from a position in the vicinity of the respective gas nozzles (1) to be substantially in parallel to the pass line of the steel strip, and obstacles (3) arranged to face partition-plate rear edges (20) in the longitudinal direction of the furnace to obstruct a flow of the gas along the steel strip, in which spaces surrounded by the traveling steel strip, the partition plates (2), and the obstacles (3) (the spaces excluding a portion in the longitudinal direction where the steel strip is not substantially siliconized) form siliconizing spaces (s) where the steel strip is siliconized by the treatment gas, gaps ($e_a$) between the partition-plate rear edges (20) and the obstacles (3), and gaps ($e_b$) between partition-plate side edges (21) and an inner wall of the furnace (the gaps excluding a portion of gaps through which the treatment gas flowing through the siliconizing spaces (s) is not substantially discharged), form exhaust passages (e) through which gas is discharged from the siliconizing spaces (s) to other spaces inside the furnace, and the treatment gas which has been sprayed from the gas nozzles (1) onto a surface of the steel strip to flow through the siliconizing spaces (s) (the treatment gas containing by-products generated by a reaction with the steel strip) is discharged through the exhaust passages (e); and performing the siliconizing treatment under a condition that satisfies relational expressions below:

$$A=T\times W\times L_S\times 10^3/([V_S]^{1/2}\times S_o),$$

$$0.005<A<0.750,$$

where, $S_o$: total area ($mm^2$) of the exhaust passages (e) formed above and below the pass line of the steel strip, $V_S$: total volume ($mm^3$) of the siliconizing spaces (s) formed above and below the pass line of the steel strip, $L_S$: length (mm) of the steel strip in the siliconizing spaces (s), W: width (mm) of the steel strip, and T: thickness (mm) of the steel strip.

2. The method for manufacturing a high-silicon steel strip by continuous siliconizing according to claim 1, wherein the siliconizing treatment is performed under a condition that satisfies a relationship of $$0.040\leq A\leq 0.700.$$

3. The method for manufacturing a high-silicon steel strip by continuous siliconizing according to claim 1, wherein the obstacles (3) below the pass line of the steel strip are hearth rolls for transporting the steel strip.

4. The method for manufacturing a high-silicon steel strip by continuous siliconizing according to claim 2, wherein the obstacles (3) below the pass line of the steel strip are hearth rolls for transporting the steel strip.

* * * * *